US012747591B2

(12) United States Patent
Lonar et al.

(10) Patent No.: US 12,747,591 B2
(45) Date of Patent: Sep. 29, 2026

(54) STAIR ASSISTANCE DEVICE

(71) Applicant: Topro Industri AS, Gjøvik (NO)

(72) Inventors: Ingrid Lonar, Trondheim (NO); Daniel Ihlen Ekelund Søndergaard, Trondheim (NO)

(73) Assignee: TOPRO INDUSTRI AS, Gjøvik (NO)

( * ) Notice: Subject to any disclaimer, the term of this patent is extended or adjusted under 35 U.S.C. 154(b) by 175 days.

(21) Appl. No.: 18/713,552

(22) PCT Filed: Nov. 25, 2022

(86) PCT No.: PCT/EP2022/083340
§ 371 (c)(1),
(2) Date: May 24, 2024

(87) PCT Pub. No.: WO2023/094620
PCT Pub. Date: Jun. 1, 2023

(65) Prior Publication Data

US 2025/0027320 A1 Jan. 23, 2025

(30) Foreign Application Priority Data

Nov. 25, 2021 (GB) ..... 2117033

(51) Int. Cl.
*E04F 11/18* (2006.01)

(52) U.S. Cl.
CPC ..... *E04F 11/1863* (2013.01)

(58) Field of Classification Search
CPC ..... E04F 11/1863; E04F 11/1802; E04F 11/1808; B66B 9/08; B66B 9/0815; B66B 9/0846; B66B 9/0807; A61H 2003/001
(Continued)

(56) References Cited

U.S. PATENT DOCUMENTS 4,913,264 A 4/1990 Voves et al.
5,269,227 A 12/1993 Warren et al.
(Continued)

FOREIGN PATENT DOCUMENTS

AU 8818791 A 6/1992
CA 2151984 A1 12/1996
(Continued)

OTHER PUBLICATIONS

Machine Translation of CN108797918 (Year: 2018).*
(Continued)

*Primary Examiner* — Ryan D Kwiecinski
(74) *Attorney, Agent, or Firm* — Command IP LLP; Pejman Yedidsion

(57) ABSTRACT

There is provided a stair assistance device 1 for assisting a person to climb up and down stairs, the device comprising: a handle; a saddle for engagement with a guide rail mounted alongside the stairs, the saddle being connected to the handle; and an engagement rack for attachment to and extending along the length of the guide rail, the saddle being engaged with the engagement rack; where the saddle is arranged for sliding motion along the guide rail and for selectively preventing motion of the handle and saddle along the guide rail, the saddle comprising: a releasable ratchet mechanism comprising a pawl engageable with a ratchet which, when engaged, prevents movement of the handle in a downstairs direction and allows movement of the handle in an upstairs direction; and where the handle is coupled to the pawl such that a predetermined movement of the handle relative to the guide rail will disengage the pawl.

22 Claims, 11 Drawing Sheets

(58) Field of Classification Search
USPC ..... 187/200, 201
See application file for complete search history.

(56) References Cited

U.S. PATENT DOCUMENTS

| | | | | |
|---|---|---|---|---|
| 10,066,398 | B1 * | 9/2018 | Guerrero | A61H 3/00 |
| 10,077,560 | B2 | 9/2018 | Medbø et al. | |
| 2004/0104078 | A1 | 6/2004 | Szentistvany et al. | |
| 2005/0224293 | A1 | 10/2005 | Molnar et al. | |
| 2005/0224294 | A1 | 10/2005 | Vroegindeweij | |
| 2006/0117984 | A1 | 6/2006 | Carlsen | |
| 2006/0243112 | A1 | 11/2006 | Debrunner | |
| 2007/0278043 | A1 | 12/2007 | Durant | |
| 2008/0264722 | A1 | 10/2008 | Yang et al. | |
| 2010/0064835 | A1 * | 3/2010 | Luckett | B66B 9/0846 238/123 |
| 2011/0278096 | A1 | 11/2011 | Kentenich et al. | |
| 2014/0150354 | A1 | 6/2014 | Danziger | |
| 2014/0231738 | A1 | 8/2014 | Amos et al. | |
| 2014/0374681 | A1 | 12/2014 | Brindamour | |
| 2016/0090743 | A1 * | 3/2016 | Medbø | E04F 11/1863 187/202 |
| 2018/0347206 | A1 * | 12/2018 | Ho | E04F 11/1863 |
| 2020/0239282 | A1 * | 7/2020 | Lodi | B66B 9/0815 |

FOREIGN PATENT DOCUMENTS

| | | | | | |
|---|---|---|---|---|---|
| CA | 2416225 | A1 | | 7/2004 | |
| CN | 108797918 | A | * | 11/2018 | E04F 11/1863 |
| DE | 202010002312 | U1 | | 6/2010 | |
| EP | 052012 | | * | 5/2012 | B66B 9/0807 |
| EP | 3004485 | A2 | | 4/2016 | |
| GB | 1487558 | A | | 10/1977 | |
| GB | 2335933 | A | | 10/1999 | |
| GB | 2436555 | A | | 10/2007 | |
| GB | 2440387 | A | | 1/2008 | |
| JP | 3885141 | B1 | | 2/2007 | |
| JP | 2007146621 | | | 6/2007 | |
| JP | 2017057592 | A | * | 3/2017 | |
| WO | WO-2019077479 | A1 | * | 4/2019 | B66B 9/0846 |

OTHER PUBLICATIONS

International Search Report and Written Opinion for PCT/EP2022/083340 mailed Mar. 2, 2023.

Stairaid Ltd, "StairAID: How does it work?" Retrieved from Internet: URL:http://www.stairaid.clientfile.net/information.php?s=How-does-it-work&section=7, Retrieved on Nov. 29, 2013, 1 Page.

* cited by examiner

STAIR ASSISTANCE DEVICE

CROSS-REFERENCE TO RELATED APPLICATIONS

This application is a 35 U.S.C § 371 National Stage Entry of International Application No. PCT/EP2022/083340, filed Nov. 25, 2022, which claims the priority benefit of United Kingdom Application No. GB 2117033.7 filed Nov. 25, 2021, the contents of all of which are hereby incorporated herein by reference in their entireties for all purposes.

FIELD OF ENDEAVOR

The current invention relates to a stair assistance device for assisting people to climb up and down stairs.

BACKGROUND

Stairs are a common feature of modern life. They are often the primary mechanism for moving between floors in buildings and in addition are widely used in outdoor spaces. It can often be the case that people find it difficult to walk up and down stairs. Mobility problems may arise as a consequence of illness, injury or disability, for example. Whilst one solution to this problem is to provide an alternative to stairs, such as a ramp, an elevator or a stair-lift, this is not possible in all situations and can be expensive. Furthermore, the action of walking up and down stairs provides valuable exercise and can be important as a means of maintaining fitness and as a part of rehabilitation when recovering from an illness or injury.

It is therefore desirable to provide a way to assist those with mobility problems to ascend and descend stairs. An assistance device should ideally be inexpensive and be capable of installation at a stairway without significant modification being required. A number of solutions have been proposed, including some using a powered device and others using an unpowered mechanical device. GB 2436555 describes a number of the known types of devices. Of these types an unpowered mechanical device is considered to be better for the present purposes since it is cheaper and easier to install. An unpowered device can also easily be used outdoors and/or in areas where electrical connection is not readily available. Other known devices include those described in GB 2440387 and the device "StairAID" sold by Crichton Manufacturing Group of the United Kingdom.

EP 3004485 describes a stair assistance device which includes a handle, a saddle configured to slide along a guide rail, and a bracket attached to the saddle. The bracket is able to selectively engage with a braking rail arranged alongside the guide rail. The bracket and the braking rail form a linear ratchet which selectively prevents or permits movement of the saddle along the guide rail. This device has the advantage that movement of the handle in an upstairs direction is permitted at all times. As a result it is possible for people with more severely impaired mobility to use the device to go up the stairs, which extends the utility of the device for exercise and rehabilitation. However, this device requires installation of a separate braking rail alongside the guide rail of the stairs, which increases installation expense and complexity, limiting the situations in which the device can be implemented. In addition, the movement of the saddle along the braking rail can cause an unpleasant 'tapping' noise as the pawl runs along the rack.

SUMMARY

It is desirable to obtain a stair assistance device with all of the advantages of the above described devices whilst avoiding the disadvantages.

Viewed from a first aspect, the invention provides a stair assistance device for assisting a person to climb up and down stairs, the device comprising: a handle; a saddle for engagement with a guide rail mounted alongside the stairs, the saddle being connected to the handle; and an engagement rack for attachment to and extending along the length of the guide rail, the saddle being engaged with the engagement rack; wherein the saddle is arranged for sliding motion along the guide rail and for selectively preventing motion of the handle and saddle along the guide rail, the saddle comprising: a releasable ratchet mechanism comprising a pawl engageable with a ratchet which, when engaged, prevents movement of the handle in a downstairs direction and allows movement of the handle in an upstairs direction; and wherein the handle is coupled to the pawl such that a predetermined movement of the handle relative to the guide rail will disengage the pawl.

Once the predetermined movement of the handle relative to the guide rail disengages the pawl, the handle may move freely in both the upstairs and the downstairs direction.

This device has the advantage that movement of the handle in an upstairs direction is permitted at all times, while movement in a downstairs direction is selectively prohibited.

The stair assistance device may comprise a friction clutch mechanism coupled to the ratchet mechanism, the friction clutch mechanism including a clutch lever configured to disengage the pawl when the handle is moved in the upstairs direction and to engage the pawl when the handle is moved in the downstairs direction. The predetermined movement of the handle may prevent the clutch lever from engaging the pawl.

The use of a friction clutch mechanism in combination with the ratchet mechanism provides considerable further advantages. It means that, unlike earlier known designs, when the device is used to assist a person going upstairs then the pawl does not repeatedly contact subsequent teeth of the ratchet, since the pawl is held out of engagement with the ratchet by the friction clutch mechanism. This advantageously reduces wear on the ratchet mechanism. Also, safety of the device is improved, since there is no noise caused by repeated engagement of the pawl which could otherwise distract the user. In addition, when the device is used to assist a person going upstairs and the handle is moved downstairs, such as by the person becoming unstable and tilting backwards, the friction clutch mechanism automatically brings the pawl back into engagement to prevent the handle from moving downstairs, without the user needing to move the handle in a particular way or apply any force: the frictional coupling means that simple movement of the saddle in the downstairs direction re-engages the pawl.

The ratchet wheel may be mounted to an axle, and may be configured to rotate about the axle. When the ratchet wheel is free to rotate (e.g. is not prevented from rotating), the ratchet wheel may rotate in a first direction when the handle is moved in an upstairs direction, and may rotate in a second direction (opposite to the first direction) when the handle is moved in a downstairs direction. The handle may only be able to move upstairs or downstairs if the corresponding rotation of the ratchet wheel is not prevented. Depending on whether the device is mounted on the left hand side or right hand side of the stairway, the first direction may be a clockwise direction and the second direction may be a counter-clockwise direction, or vice versa. For instance, when the user is at the bottom of the stairway facing up the stairs and the saddle is mounted on the user's left hand side, the first direction may be a counter-clockwise direction and the second direction may be a clockwise direction.

In an engaged position of the pawl, the pawl may prevent the ratchet wheel from rotating about the axle in the second direction, e.g. by obstructing a tooth of the ratchet wheel. Thus, in the engaged position of the pawl, downstairs movement of the handle can be prevented. In a disengaged position of the pawl, the pawl may not obstruct the teeth of the ratchet wheel and hence the ratchet wheel may freely rotate in either direction. Thus, in the disengaged position of the pawl, movement of the handle is not prevented.

The friction clutch mechanism may interact with the ratchet mechanism. The friction clutch mechanism may act to disengage the pawl when the handle is moved in the upstairs direction and to engage the pawl when the handle is moved in the downstairs direction, thereby allowing upstairs movement of the handle and preventing downstairs movement of the handle. Complete disengagement of the pawl during upstairs movement advantageously eliminates noises typically associated with ratchet mechanisms, such as tapping or ticking noises as the pawl engages with each subsequent tooth.

The friction clutch mechanism may be implemented in different ways. In one example, the friction clutch mechanism comprises the clutch lever and a clutch disc coupled to the ratchet wheel. The ratchet wheel and the clutch disc may be coaxial. The clutch disc and the ratchet wheel may be in direct contact, e.g. a face of the ratchet wheel contacts a face of the clutch disc. Alternatively, there may be an intermediate component (e.g. a friction washer) arranged therebetween. A clutch spring may also be provided and arranged to provide pressure to the clutch disc. Thus the rotating ratchet wheel may drive the clutch disc to rotate by applying a frictional force on the clutch disc, directly or via the intermediate component.

The clutch disc may be arranged to actuate the clutch lever to engage or disengage the pawl based on rotation of the ratchet wheel. The clutch lever may therefore be a linkage between the clutch disc and the pawl. The pawl may be integrally formed with the clutch lever, or the pawl may be fastened or rigidly attached to the clutch lever in other ways. The angle between the clutch lever and the pawl may be fixed or constant, so that rotation of the clutch lever will cause a corresponding rotation of the pawl and vice versa. Thus rotation of the clutch disc can move the clutch lever to lever the pawl to rotate into or out of engagement with the ratchet wheel. In one example, a first end of the clutch lever is seated in a notch formed in the outer circumference of the clutch disc, and a second end of the clutch lever is rigidly attached to the pawl.

The engagement rack may be fixed to the guide rail. Preferably, the engagement rack is arranged in a slot in the guide rail. This may provide for a secure attachment and easy installation and compactness of the engagement rack within the guide rail. The engagement rack is optionally provided at the base (e.g. the underside) of the guide rail. Thus the remainder of the guide rail (e.g. the top and sides of the guide rail) can be available for use as a normal hand rail. Additionally, the engagement rack located at the base or underside of the guide rail is protected from adverse conditions such as weather and dirt, reducing the likelihood of blockage of or damage to the engagement rack. Thus the saddle can move easily along the engagement rack, and unobstructed movement of the saddle can be achieved.

The saddle may comprise an engagement component arranged to engage with the engagement rack. The engagement component is preferably a sprocket. One preferred arrangement is to provide an engagement rack having teeth formed along the length of the material of the engagement rack and separated by depressions or indents, wherein the teeth of the sprocket interlock with the teeth of the engagement rack. Thus, the engagement rack may comprise a strip of generally rigid material with teeth spaced along the strip. The sprocket may be mounted to an axle and may be configured to rotate about the axle. In this arrangement, as the saddle moves along the guide rail, the sprocket will begin to rotate about the axle due to the interaction of the teeth of the sprocket and the teeth of the engagement rack. The sprocket will thus rotate clockwise or counter-clockwise about the axle (from the point of view of the person using the stair assistance device) depending on whether the handle is moved upstairs or downstairs.

The ratchet wheel and the sprocket may be mounted to the same axle. Thus, rotation of the sprocket and rotation of the ratchet wheel may be synchronised, so that rotation of the sprocket causes rotation of the ratchet wheel and vice versa. Conversely, when rotation of the ratchet wheel is prevented (e.g. due to engagement of the pawl), rotation of the sprocket is also prevented. In this way, engagement of the pawl can prevent movement of the saddle along the guide rail.

The predetermined movement of the handle relative to the guide rail may be any suitable movement. The only essential feature is that the movement disengages the pawl from the ratchet mechanism, and prevents the clutch lever from engaging the pawl if a friction clutch mechanism is provided. For example, there may be a linkage between the handle and the pawl and/or the clutch lever that acts to rotate or pivot the pawl (directly or via the clutch lever) away from its engaged position and retain the pawl in the disengaged state. The linkage may be provided by a ratchet pull element. The ratchet pull element may be biased towards a normal position (e.g. a position which does not prevent pawl engagement), and thus may be termed a ratchet pull spring. In a preferred embodiment the predetermined movement is a simple lifting or tilting of the handle to rotate the handle about the long axis of the guide rail. This movement may cause the handle to rotate about a fold axle of the folding mechanism and apply a force to the ratchet pull element which in turn applies a force to the pawl and/or the clutch lever to thereby disengage the pawl. The clutch lever (if present) may be unable to re-engage the pawl while the handle is tilted. For instance movement of the pawl and/or the clutch lever may be prevented or obstructed by the ratchet pull spring while the handle is tilted. This motion uses minimal moving parts and it is simple for the user. Thus, when going upstairs the handle may be in any position, which allows upstairs use by people with a wide range of movement capabilities. When going downstairs the device can move freely when lifted, but the pawl will engage in the ratchet mechanism to prevent downstairs movement of the handle when the handle is not sufficiently lifted. Hence, this arrangement permits upward movement for a less able user.

A first end of the ratchet pull spring may be coupled to the folding mechanism and a second end of the ratchet pull spring may be configured to interact with the pawl and/or the clutch lever. In a first position of the ratchet pull spring, movement of the pawl between the engaged position and the disengaged position and corresponding movement of the clutch lever may be unobstructed. In a second position of the ratchet pull spring, the ratchet pull spring may obstruct the pawl and/or the clutch lever, and hence prevent movement thereof. The predetermined movement may move the ratchet pull spring from the first position to the second position and thereby disengage the pawl. In one specific example, the ratchet pull spring has an elongated shape with a flange formed at the second end. In the first position of the ratchet pull spring, the flange does not obstruct the pawl and/or clutch lever, and in the second position, the flange obstructs the pawl, retaining it in the disengaged position.

In examples comprising a friction clutch mechanism, the friction between the ratchet wheel and the clutch disc is advantageously low enough that the ratchet wheel can keep rotating even if the clutch disc is prevented from rotating. Thus, even when the ratchet pull spring is positioned to disengage the pawl and prevent the clutch lever and clutch disc from moving, the ratchet wheel can still rotate, and hence the saddle can still move along the engagement rack. In this way, the predetermined movement allows the handle to move freely in both directions.

In embodiments in which a ratchet pull spring and a ratchet wheel are included, another benefit is provided in that when a person puts a lot of weight on the device in the downwards direction of the staircase and lifts the handle, the person will not be able to pull the pawl up and out of engagement with the ratchet wheel. This is because, due to the angle of the pawl and the ratchet wheel, and due to high friction between the pawl and the ratchet wheel from the force/weight of the person, the pawl and ratchet wheel will be locked into each other. Thus, when the force between the pawl and the ratchet wheel is greater than the spring force of the ratchet pull spring, then although the ratchet pull spring will apply a lifting force to the pawl when the handle is lifted, the ratchet pull spring will not be able to lift the pawl since the lifting force cannot overcome the load applied by the person. Therefore this provides a further safety aspect in that the device will not be able to move along the stair rail in this condition and hence the handle will be a stable object with which the person can steady themselves.

Depending on the requirements of the particular stairway in which the stair assistance device is installed, the saddle may be installed on the left or right hand side of the stairway (e.g. relative to a user standing at the bottom of the stairway and looking up the stairs). It is therefore preferable that the saddle can be arranged in both a left-handed and right-handed configuration, i.e. mirrored configurations, so that the same saddle can be installed on either side as needed. In one example, some, and preferably all, of the components in the saddle may be symmetrical or right-left reversible about a plane perpendicular to the guide rail. For instance some components, such as components of the friction clutch mechanism and/or the ratchet mechanism (e.g. the ratchet wheel, pawl, clutch lever, clutch disc, etc), may be configured such that a 180° rotation results in a mirrored version of said component. Other components, such as the ratchet pull spring, the sprocket and/or the saddle frame assembly, may be symmetrical and thus no rotation of these components is needed. As a result, the saddle can be assembled in a mirrored configuration (i.e. rearranged between a left-handed version and a right-handed version) without replacing or reforming the components. Some or all of the elements of the handle may also be symmetrical or reversible in this way.

The handle may include gripping portions for ease of use both going upstairs and downstairs. The gripping portions may include a central gripping portion extending perpendicular to the guide rail and over the stairs, when the handle is in use. The handle may include one or more lateral gripping portions which may extend outwards from the central gripping portion, e.g. vertically upwards and/or downwards. Each lateral gripping portion may comprise a loop for ease of holding. The handle may therefore allow for a variety of holding configurations depending on the individual user's needs. In one example the gripping portions form an H-shape, with each leg of the H being a loop, so as to provide multiple lateral gripping regions whilst not obstructing the user's vision or movement along the stairs. The handle is preferably symmetrical in shape so as to be mounted on the left or right hand side of the stairway.

The saddle may be adapted to slide along the guide rail. For instance the saddle may be in frictional contact therewith, or the saddle may include rotating bearing means for rolling contact with the guide rail, for example wheels or rollers. This reduces wear and provides an easier sliding motion. The saddle may comprise a frame assembly which provides a support structure for the components of the saddle (e.g. the rotating bearing means, the ratchet mechanism, the sprocket, and/or the friction clutch mechanism). The frame assembly helps to move the saddle along the guide rail and takes up the load applied on the handle by the user.

The saddle may be configured to permit articulation of the front and/or rear portion. The frame assembly may comprise one or more frames arranged on or about the guide rail. The one or more frames may include a main frame, e.g. for housing the ratchet mechanism, the friction clutch mechanism, the ratchet pull mechanism, and/or rotating bearing means, and optionally one or more side frames disposed adjacent and connected to the main frame. The side frames may also include rotating bearing means. Preferably, at least one side frame is located in front of (i.e. upstairs of) the main frame, and at least one side frame is located behind (i.e. downstairs of) the main frame. Each side frame may be connected to the main frame by a fastener, e.g. a bolt, and may be rotatable about the fastener. The saddle may advantageously permit articulation of the front and/or rear side frame relative to the main frame, which enables the saddle to ride around corners in the rail whilst keeping close contact with the rail surface. For instance the side frames may be connected to each other and/or to the main frame via an articulated joint which allows for relative movement between the frames. The joint may for instance be a hinge type joint, a ball-and-socket type joint, or any other suitable joint type that permits relative movement of the frames.

The guide rail is preferably similar in form to a conventional stair rail and in some cases a pre-existing stair rail may be used as the guide rail. This makes installation of the assistance device easier, and simply requires the pre-existing stair rail to be compatible with the saddle and to be able to receive the engagement rack. Alternatively a dedicated guide rail may be provided, for example a rail that is made of a hardwearing material to allow for sliding contact with the saddle and/or to be particularly configured to receive the engagement rack, e.g. by including a slot. Whether or not a pre-existing stair rail is used the guide rail advantageously provides the same function as a stair rail, which means that able bodied users can use the stairway as normal. The stair assistance device may include a guide rail as a component part of the device. In this case the device may also include one or more wall brackets, preferably brackets for mounting the guide rail on a wall.

The guide rail may have a specialised internal structure adapted for use with the stair assistance device described above and/or for other uses. The guide rail may be generally cylindrical and may include one or more internal channels extending through the rail. The channels may be adapted for various uses. For instance, a first channel may be for receiving a heat cable, which is particularly advantageous in outdoor uses. The first channel may be a closed channel, e.g. sealed within the guide rail except for an opening at each end of the rail to allow for insertion of the cable. A second channel may be for receiving a rail-connecting component, e.g. a bolt, for joining two rails together. The second channel may be a closed channel. It is desirable for there to be minimal or no step or discontinuity between adjacent rail sections in order to ensure the saddle can slide freely and smoothly over the joint and along the guide rail. The rail-connecting component may therefore securely join two rails together and provide continuity between the rails. This ensures that the transition between the rails is and remains smooth after repeated load and wear, e.g. by the saddle. A third channel may be for receiving one or more of a second rail-connecting component, a portion of a wall-bracket for mounting the guide rail to a wall, and/or a grip strip (e.g. a strip of material with relatively high friction) for providing grip to users of the guide rail. The third channel may be an open channel, e.g. exposed to the surroundings on one side along the length of the channel so that a user's hand can contact the grip strip. A fourth channel may be for receiving an engagement rack, e.g. the engagement rack of a stair assistance device as described previously. The fourth channel may be an open channel, which enables the engagement component of the saddle to engage with the engagement rack. The guide rail may include any number or combination of these and/or other channels or features of guide rails as known in the art.

One or more brackets may connect the guide rail to a wall and/or the ground (e.g. to steps of the stairway), depending on the surroundings of the stairway. There are various ways in which the bracket can be connected to the rail. The bracket may include an insertion portion for insertion into a channel of the guide rail, e.g. a channel described above. The insertion portion may be sized and shaped so as to substantially match the contour of the channel. This ensures a close fit of the bracket. The insertion portion is preferably slightly smaller than the channel to enable insertion thereof, and thus it is advantageous for the bracket to be tightened to the guide rail after insertion. One way this can be achieved is by enlarging or expanding the bracket after insertion into the rail so as to create tension between the rail and the bracket. Thus there may be provided a bracket-tension component for tightening the bracket to the guide rail. The bracket-tension component may also be for insertion into the channel. The bracket-tension component may therefore include a body portion which is sized and shaped to substantially match the contour of the channel. The insertion portion of the bracket may include an opening for receiving a corresponding portion of the bracket-tension component. The size of the opening may be slightly smaller than the size of the corresponding portion of the bracket-tension component. In this way, when the bracket-tension component is inserted into the opening, the bracket expands against the wall of the channel, creating a tight fit under tension.

In one specific example, the opening has a narrowed shape (e.g. the diameter of the opening decreases with distance into the rail) and the bracket-tension component includes a corresponding tapered portion (e.g. an elongated portion with a decreasing diameter). The tapered portion may extend outwardly from the body portion. The narrowest part of the tapered portion is preferably larger than the narrowest part of the opening. Thus, as the tapered portion is pushed further into the opening, the bracket insertion portion will expand outwardly against the channel of the guide rail. This secures the bracket under tension, creating a secure fit of the bracket to the guide rail.

The bracket-tension component may be fastened to the bracket using any suitable fastener, e.g. a bolt. As the fastener is tightened, the portion of the bracket-tension component (e.g. the tapered portion) will be wedged further inside the opening (e.g. the narrowed opening), thus increasing the tension of the fit.

The combination of the bracket and bracket-tension component which achieves a secure connection between the bracket and the guide rail is considered to be novel and inventive in its own right.

Thus, viewed from a second aspect, the invention provides a rail-mounting assembly comprising: a rail for being mounted to a wall, the rail comprising one or more channels extending therethrough; a bracket mountable to the wall and configured for attachment to the rail; and a bracket-tension component for tightening the bracket to the rail; wherein the bracket comprises an insertion portion configured for insertion into a channel of the rail, the insertion portion including an opening formed therein; and wherein the bracket-tension component comprises a portion configured for insertion into the opening; wherein the opening of the bracket and the corresponding portion of the bracket-tension component are sized such that insertion of the bracket-tension component portion into the opening after insertion of the insertion portion into the channel enlarges the insertion portion within the channel and creates tension there between.

The rail-mounting assembly may include additional features as described above and/or below. The rail-mounting assembly can be provided in addition to or separately from the stair assistance device described herein.

The bracket may be mounted to a wall of the stairway using any suitable mounting means. The bracket may be adjustable to enable the bracket to be adapted depending on the relative position and orientation of the rail and the wall. For instance the bracket may include a telescopic portion for adjusting the depth of the bracket (e.g. the distance between the rail and the wall). The telescopic portion may include a first portion slidably engaged within a second portion. This configuration enables the length of the telescopic portion to be varied by sliding the first portion further into or out of the second portion. The length of the telescopic portion may be fixed by using a fastener (e.g. a set screw) to set the position of the first portion relative to the second portion. The bracket may include a rotatable portion for adjusting the angle of the bracket relative to the rail. The rotatable portion may rotatably coupled to the telescopic portion and rotatable about an axis defined by the telescopic portion. The angle of the rotatable portion may be settable, e.g. using a set screw or any other suitable fastener.

The guide rail may be provided in segments that are coupled together by one or more rail-connecting components, e.g. a tension bolt. The rail-connecting component(s) may be configured for insertion into a channel in the guide rail, e.g. by a friction fit. The segments or rail sections may be coupled at each bracket. This makes it easy to combine straight and curved rail segments to fit the shape of a stairway.

The guide rail may be included as a part of the claimed assistance device or included in a kit supplied to the user for installation along with the assistance device.

It will be appreciated that in some circumstances the presence of the assistance device could hinder normal use of the stairway. For example there may not be space for the handle to be stowed out of the way of the stairs at the top or bottom of the stairway. This will particularly be the case when the assistance device is used in the home, where there may be limited space on and around the stairway. Therefore, the device may include a folding mechanism that enables the handle to be folded away. This can advantageously avoid restriction of normal use of the stairway.

A folding mechanism is made more complicated when the handle includes lateral gripping portions, since the handle will then extend in a vertical direction as well as in a direction perpendicular to the guide rail. In this situation there is a plane of the handle that extends in the vertical direction in normal use and it is desirable to rotate the handle so that this plane is parallel to a wall of the stairway.

An example folding mechanism may involve a hinged connection of the handle to the saddle. The folding mechanism may comprise a single rotating joint that couples the handle to the saddle. The rotating joint may comprise a fixed portion fixed to the saddle and a rotatable portion fixed to the handle and rotatable relative to the fixed portion, so as to provide a rotation of the handle about a vertical axis relative to the saddle. The rotation may also be a rotation about a horizontal axis relative to the saddle, e.g. a combination of rotation about the vertical and horizontal axis such that there is a vertical component and a horizontal component of rotation. The folding mechanism may further comprise a spring lock that prevents rotation of the handle until it is disengaged. The spring lock may, for example, be disengaged by pushing an actuation button or lever. It is preferred for the spring lock to automatically re-engage when the handle is returned to the position for normal use. The spring lock may also automatically re-engage when the handle is placed into the folded position, e.g. the position in which the plane of the handle is parallel to the plane of the wall.

The spring lock may comprise a rod extending through the handle, e.g. a central portion of the handle. A first end of the rod (preferably an end proximal to the rail) may be arranged to engage with the fixed portion of the rotating joint when the handle is engaged. In a simple example, the rod may slot into an opening in the fixed portion. This prevents the handle from rotating about the vertical axis relative to the saddle. A second end of the rod (preferably an end distal from the rail) may be coupled to the actuation lever. Pressing of the actuation handle may disengage the rod from the fixed portion (e.g. retract the rod from the opening) and hence disengage the lock. In the folded position, the rod may engage with the fixed portion of the rotating joint, such as by slotting into a second opening in the fixed portion. The rod may automatically re-engage with the fixed portion, e.g. by a biasing element or spring, when the handle is in the normal or folded position and the actuation lever has been released. This mechanism allows for easy operation as only one hand is required to actuate the spring lock. In addition, providing the actuation lever on the outside of the handle (i.e. the end distal from the rail) allows for easy access, even when the handle is in the folded position. When the handle is folded and locked, it can function as an extension of the guide rail itself which can be useful in spaces where the rail cannot be extended further.

The folded position may also lock the pawl in place. For instance, the stair assistance device may include a movement control mechanism which is configured to allow movement of the pawl when the handle is in the normal position and to prevent movement of the pawl when the handle is in the folded position. In one example, the movement control mechanism is configured such that in the normal position, the handle can undergo the predetermined movement relative to the saddle to disengage the pawl, and in the folded position the handle is prevented (e.g. obstructed) from moving in the predetermined manner, thus preventing the pawl from disengaging and thereby locking the pawl in place. In a specific example, the handle comprises an aperture and the saddle comprises a protrusion (e.g. a pin), wherein the protrusion and the aperture are in alignment when the handle is in the normal position and are out of alignment when the handle is in the folded position. Thus, when the protrusion and aperture are aligned, the predetermined movement of the handle is not obstructed because the protrusion can enter the aperture, whereas when the protrusion and the aperture are not aligned, the protrusion obstructs the handle and prevents the predetermined movement. The protrusion may be formed integrally with the saddle or secured thereto.

BRIEF DESCRIPTION OF THE DRAWINGS

Certain preferred embodiments of the invention will now be described by way of example only and with reference to the accompanying drawings, in which.

DETAILED DESCRIPTION

Figure 1:
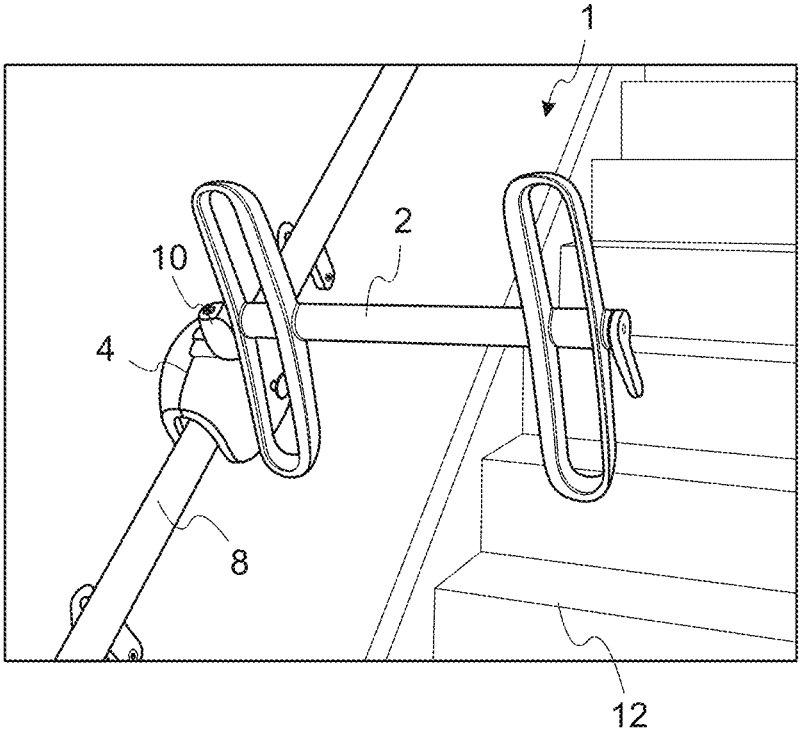
FIG. 1 shows a stair assistance device.

The stair assistance device 1 of FIG. 1 has three main parts, comprising a handle 2, a saddle 4, and an engagement rack (not visible). The stair assistance device 1 is connected onto a guide rail 8, which is similar in design to a conventional stair rail. The guide rail 8 can be supplied for installation with the stair assistance device 1 or an existing stair rail may be used. The handle 2 is attached to the saddle 4. The stair assistance device 1 also includes a folding mechanism 10, which is located between the saddle 4 and the handle 2, and which is discussed in more detail below. The guide rail 8 extends along a stairway following the stairs 12, and is mounted to a wall of the stairway. As shown in more detail in FIGS. 2 and 3, the engagement rack 6 is attached to and forms part of the guide rail 8, and extends along the length of the guide rail 8.

Figure 2:
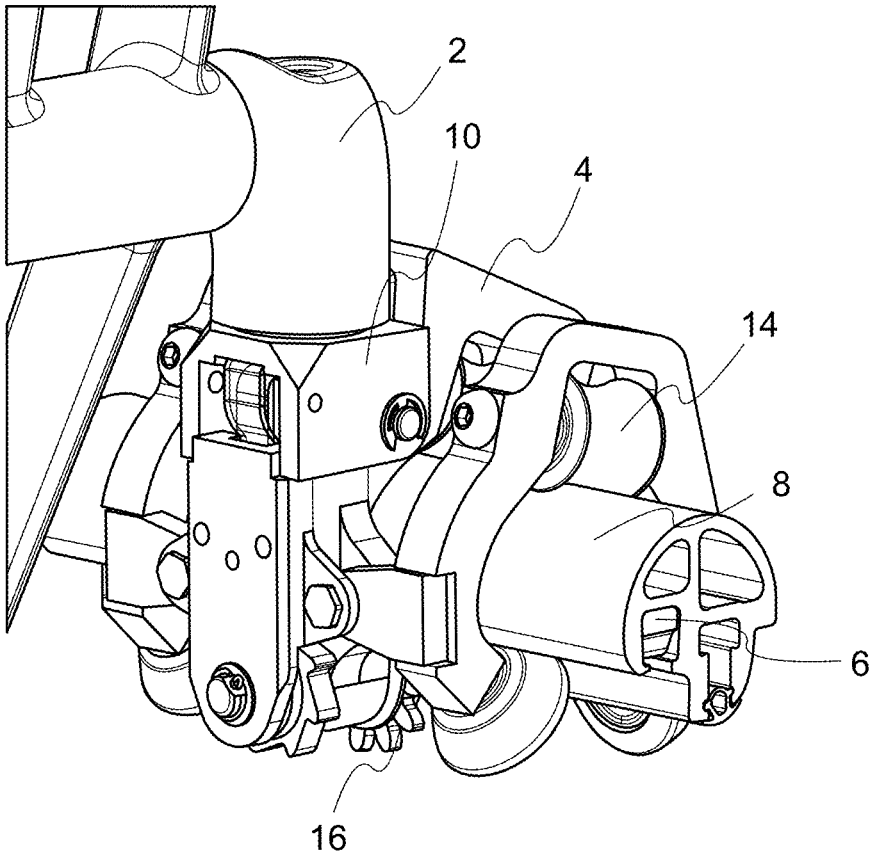
FIG. 2 shows a close up view of the saddle and guide rail.
Figure 3:
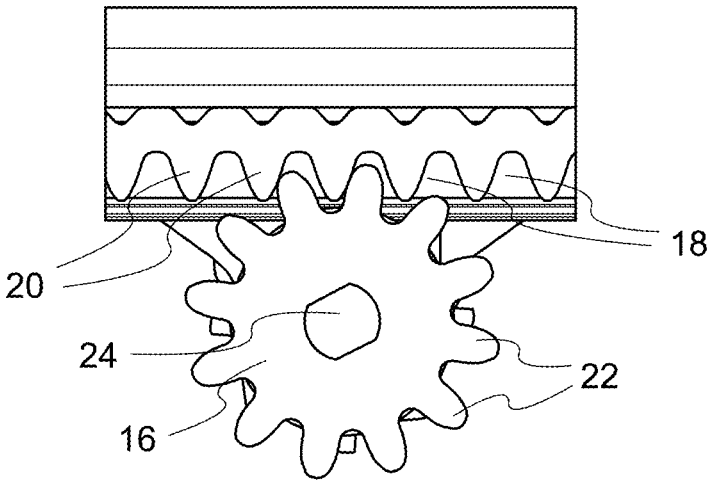
FIG. 3 shows the sprocket and engagement rack.
Figure 5:
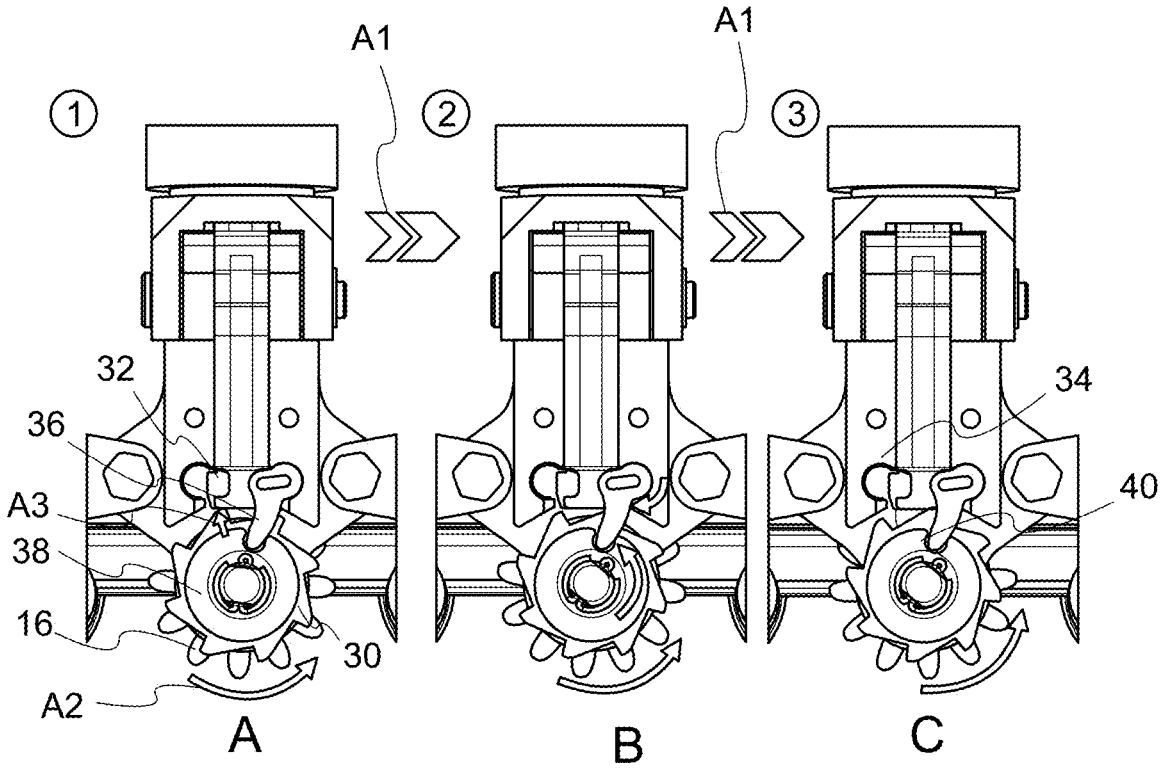
FIG. 5 is a sequence of diagrams showing how the ratchet mechanism and friction clutch mechanism operate during an upstairs movement along the guide rail.
Figure 6:
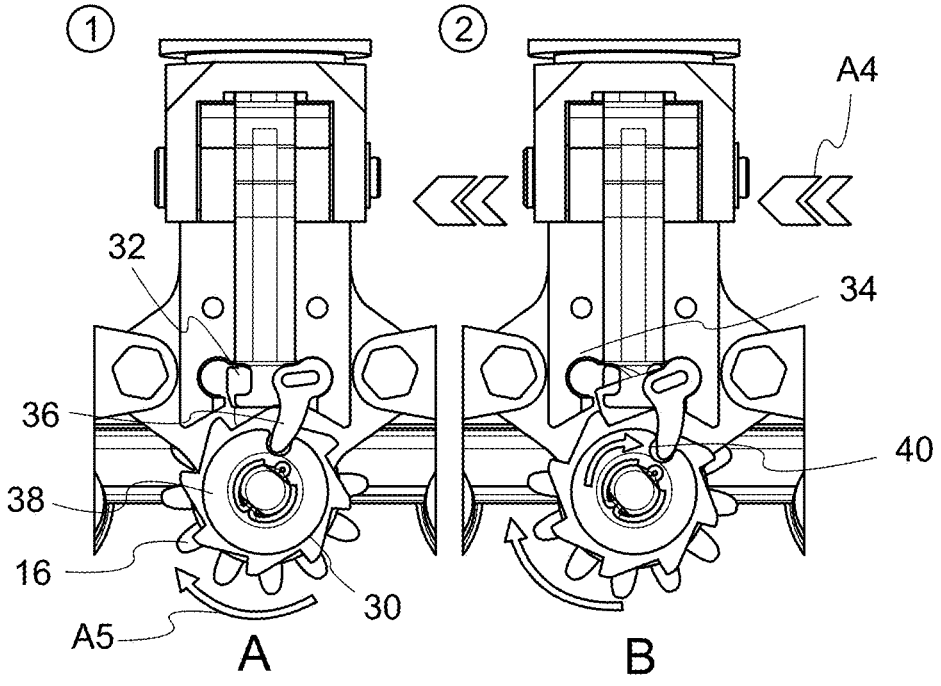
FIG. 6 is a sequence of diagrams showing how the ratchet mechanism and friction clutch mechanism operate during a downstairs movement along the guide rail.

FIG. 2 shows a close up of the connection of the saddle 4 to the guide rail 8 and the engagement rack 6. The handle 2 is coupled to the saddle 4 via the folding mechanism. The engagement rack 6 is arranged in a slot in the underside of the guide rail 8. The saddle 4 is fitted to the guide rail 8 using rollers or wheels 14 and hence can slide up or down the guide rail 8. The saddle 4 includes a sprocket 16 which is mounted to and rotatable about an axle 24. The sprocket 16 engages with the engagement rack 6, as shown in closer detail in FIG. 3. The engagement rack 6 comprises a strip of material including a sequence of depressions 18 that form a rack, with the material between the depressions 18 acting as the teeth 20 of the rack. The teeth 22 of the sprocket 16 interlock with the teeth 20 of the engagement rack 6. When the sprocket 16 is able to rotate (e.g. it is not prevented from rotating), the saddle 4 can move along the engagement rack 6 and hence along the guide rail 8. When the sprocket 16 cannot rotate, the saddle 4 cannot move along the engagement rack 6 or the guide rail 8. Thus the saddle 4 can selectively prevent movement of the handle 2 up or down the stairs 12 by preventing rotation of the sprocket 16. This is achieved using a ratchet mechanism 26 and a friction clutch mechanism 28 disposed within the saddle 4, as shown in FIGS. 4 to 6 and described below.

Figure 4:
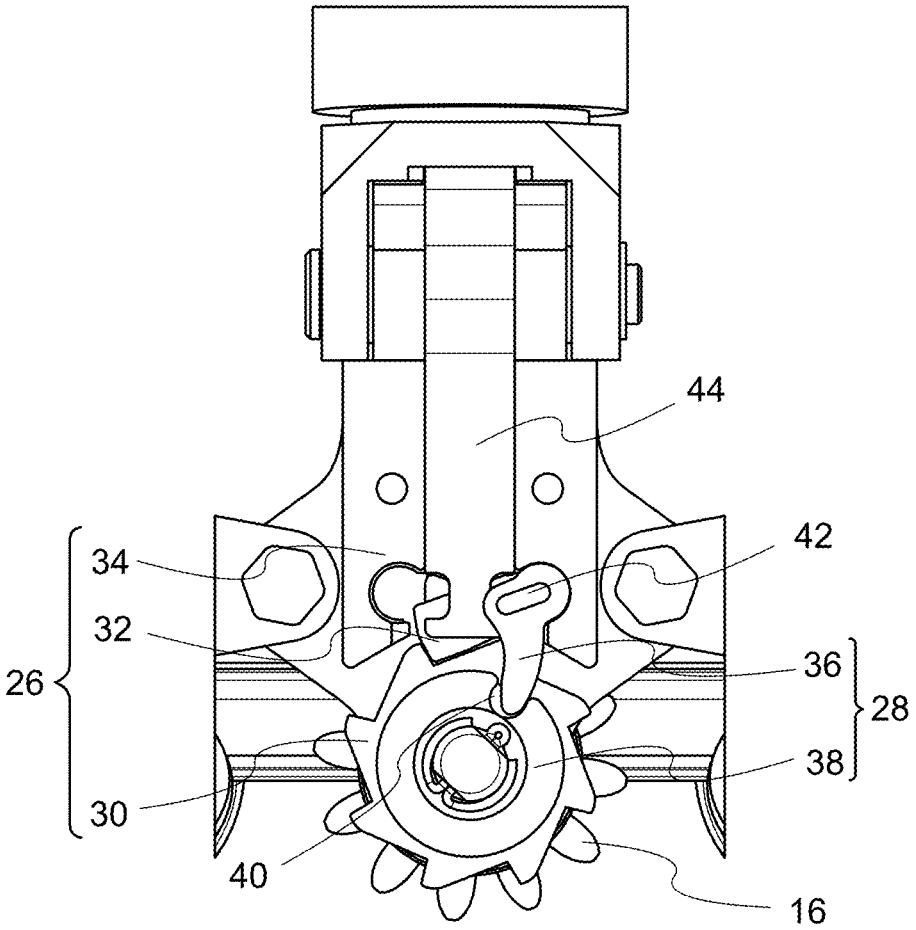
FIG. 4 shows the ratchet mechanism and friction clutch mechanism in an engaged position.

FIG. 4 shows the ratchet mechanism 26 and the friction clutch mechanism 28 of the saddle 4 which enables the selective prevention of movement of the handle 2. The ratchet mechanism 26 comprises a ratchet wheel 30 and a pawl 32 engageable with the ratchet wheel 30. In FIG. 4, the pawl 32 is in an engaged position in which the pawl 32 is seated between adjacent teeth of the ratchet wheel 30. The pawl 32 is biased into engagement with the ratchet wheel 30 by a ratchet spring 34. The ratchet wheel 30 is mounted to the sprocket axle 24, so that rotation of the sprocket 16 and the ratchet wheel 30 is synchronised.

The friction clutch mechanism 28 interacts with the ratchet mechanism 26 to engage and disengage the pawl 32 based on rotation of the ratchet wheel 30. The friction clutch mechanism 28 comprises a clutch lever 36, a clutch disc 38, and a clutch spring (not shown). A first end of the clutch lever 36 is seated in a notch 40 in the clutch disc 38, and a second end of the clutch lever 36 is fixed to the pawl 32. In this example the clutch lever 36 is fixed to a protrusion 42 that extends outwardly from the pawl 32, but the components could instead be integrally formed or rigidly connected in other ways. The clutch lever 36 and the pawl 32 define an angle therebetween, which is a fixed angle due to the rigid connection between the pawl 32 and the clutch lever 36. The clutch disc 38 is coupled to the ratchet wheel 30 via a friction disc (not shown).

The saddle 4 also comprises a ratchet pull spring 44, which is arranged to interact with the pawl 32. In FIG. 4, the ratchet pull spring 44 is in a first position in which the ratchet pull spring 44 does not obstruct movement of the pawl 32. Operation of the ratchet pull spring 44 will be discussed in more detail later.

In the engaged position of the pawl 32 as shown in FIG. 4, the pawl 32 abuts the ratchet wheel tooth and would prevent downstairs (leftward) movement of the saddle 4. If the saddle 4 moves in an upstairs direction (to the right) then the pawl 32 is rotated into the disengaged position and over the next tooth, as discussed below.

The sequence of diagrams in FIG. 5 shows the operation of the ratchet mechanism 26 and the friction clutch mechanism 28 as the handle 2 is moved in an upstairs direction (to the right, as indicated by the arrows A1). As the handle 2 is pushed upstairs, the saddle 4 begins to move along the guide rail 8. The sprocket 16 rotates in the direction indicated by the arrow A2 due to interaction with the teeth 20 of the engagement rack 6. This causes the ratchet wheel 30 to rotate about the common sprocket axle 24. As the ratchet wheel 30 rotates, the pawl 32 slides along the angled tooth of the ratchet wheel, thus moving upwards as shown by the arrow A3. As shown in FIG. 5 *b*), rotation of the ratchet wheel 30 drives the clutch disc 38 to rotate due to friction therebetween. The notch 40 of the clutch disc 38 thus rotates and pushes against the clutch lever 36 seated therein, causing the clutch lever 36 to pivot and to lever the pawl 32 out of engagement. The pawl 32 is hence moved against the force of the ratchet spring 34 by both the angled teeth and the clutch lever 36, and does not restrict motion of the saddle 4 along the engagement rack 6.

The ratchet spring 34 does not push the pawl 32 into engagement with the next tooth, because the clutch lever 36 holds the pawl 32 in the disengaged position. Thus, during an upstairs motion the saddle 4 and handle 2 move freely up the guide rail 8 and the user can walk up the stairs using the handle 2 for additional balance and stability. Additionally, because the pawl 32 is prevented from re-engaging the ratchet wheel 30 by the friction clutch mechanism 28 during upstairs motion, the undesirable 'tapping' noise caused by the pawl 32 continually engaging subsequent ratchet wheel teeth is eliminated. Moreover, the friction clutch mechanism 28 requires no actuation or input from the user because it relies on a frictional relationship with the ratchet mechanism 26 and hence it has simple operation.

The sequence of diagrams in FIG. 6 shows the operation of the ratchet mechanism 26 and the friction clutch mechanism 28 as the handle 2 is moved in a downstairs direction (to the left, as indicated by the arrows A4). The sprocket 16 rotates in the direction indicated by the arrow A5, again due to the teeth 20 of the engagement rack 6. This causes the ratchet wheel 30 to rotate about the axle 24. As the ratchet wheel 30 rotates, the pawl 32 is engaged with the ratchet wheel 30 due to the ratchet spring 34 pushing the pawl 32 downwards and by action of the friction clutch mechanism 28. A shown in FIG. 6 *b*), rotation of the ratchet wheel 30 drives the clutch disc 38 to rotate in the second direction due to friction therebetween. The notch 40 thus moves in the second direction, pushing the clutch lever 36 seated therein and causing the clutch lever 36 to pivot and lever the pawl 32 into engagement. The pawl 32 then restricts further rotation of the ratchet wheel 30. Since rotation of the sprocket 16 and ratchet wheel 30 is synchronised, motion of the sprocket 16 and hence the saddle 4 along the engagement rack 6 is prevented. Thus, if the user becomes unbalanced or falls while moving upstairs, then any downstairs motion of the handle 2 is prevented and the user can stabilise themselves using the handle 2.

It will be appreciated that a small amount of downstairs motion will occur while the pawl 32 is levered into engagement with the ratchet, but this movement is relatively very small and will not have any effect on the user experience.

Figure 7:
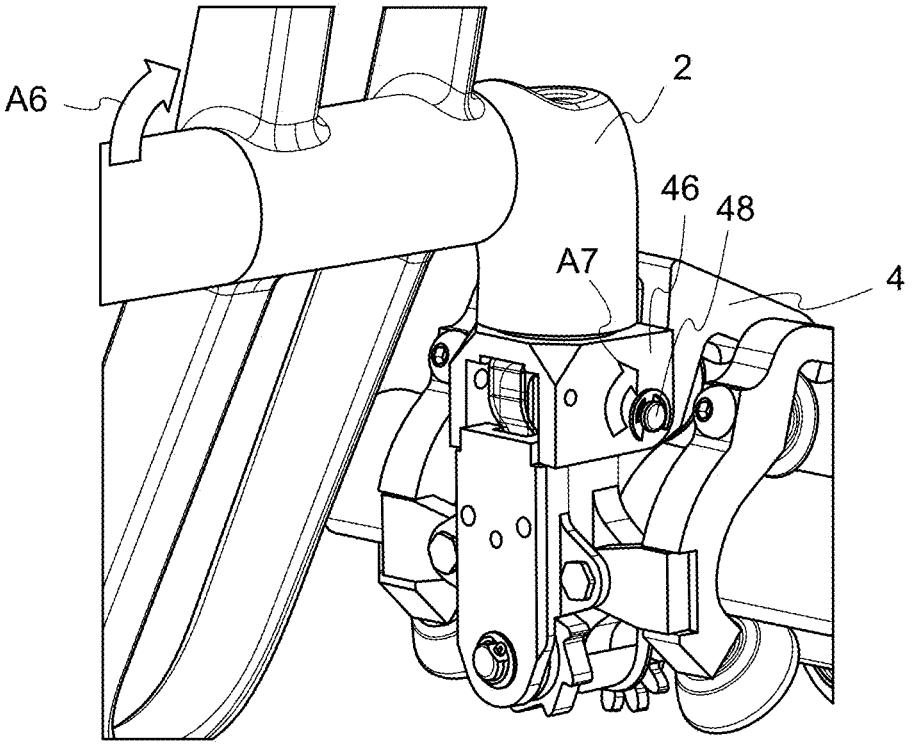
FIG. 7 shows how the handle can be moved to permanently disengage the pawl.
Figure 8:
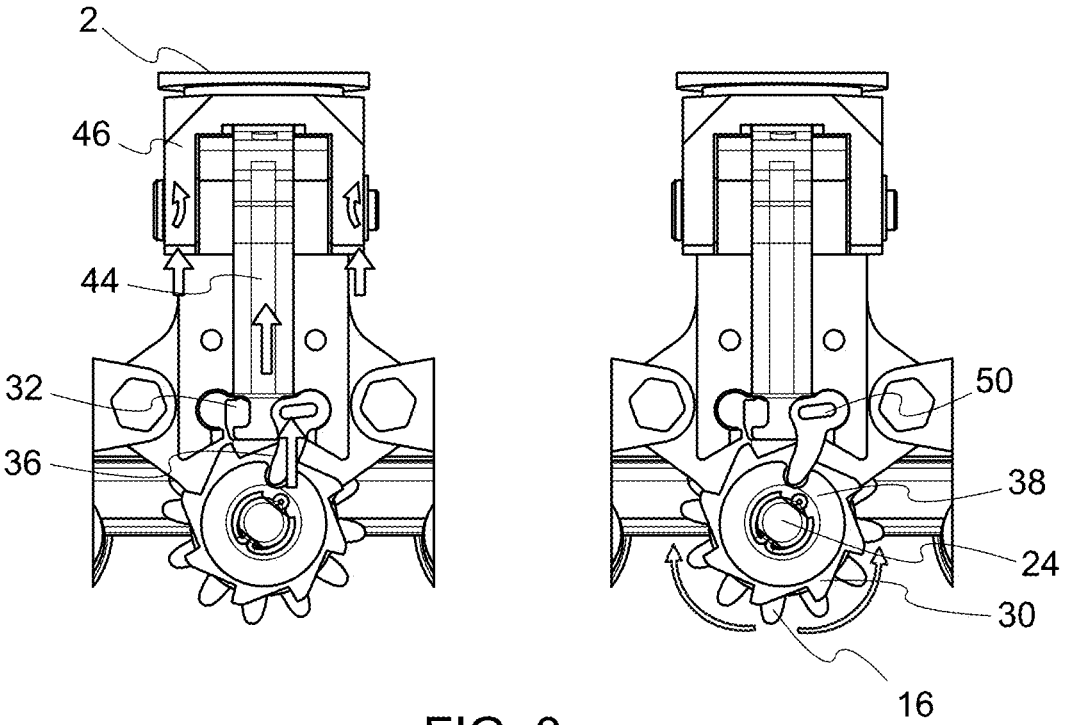
FIG. 8 is a sequence of diagrams showing the ratchet mechanism and friction clutch mechanism when the handle is used to permanently disengage the pawl.

FIGS. 7 and 8 show how a predetermined movement of the handle 2 permits a downstairs movement of the stair assistance device 1. The handle 2 is coupled to the saddle 4 by the folding mechanism 10 which comprises a fold component 46 fastened to the saddle 4. To perform the predetermined movement, the handle 2 should be tilted or lifted as shown by arrow A6. This causes the handle 2 and the fold component 46 to rotate in the direction indicated by arrow A7 about a fold axle 48 of the folding mechanism 10. As shown in FIG. 8, the ratchet pull spring 44 is coupled to the fold component 46. Thus, as the handle 2 is tilted or lifted, the ratchet pull spring 44 is also lifted. During this movement a flange 50 of the ratchet pull spring 44 engages with and applies a pulling force to the pawl 32, thus pulling the pawl 32 out of engagement. While the handle 2 is maintained in the lifted position, the ratchet pull spring 44 will retain the pawl 32 out of engagement by obstructing any movement of the pawl 32. Since the clutch lever 36 is rigidly fixed to the pawl 32, retention of the pawl 32 also prevents the clutch lever 36 or clutch disc 38 from moving, and hence prevents the friction clutch mechanism 28 from actuating the pawl 32. However, due to the frictional coupling between the clutch disc 38 and the ratchet wheel 30, the ratchet wheel 30 can still rotate. Thus, the ratchet wheel 30 and sprocket 16 (via the sprocket axle 24) can rotate freely both clockwise and counter-clockwise. This enables the saddle 4 and handle 2 to move both upwards and downwards along the guide rail 8.

Figure 9:
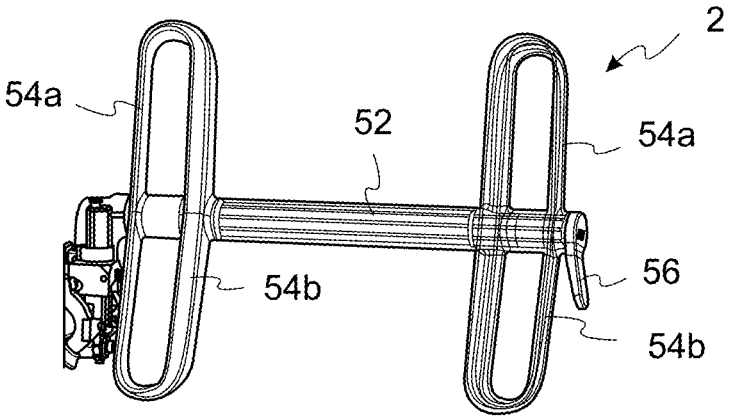
FIG. 9 shows the handle.
Figure 10:
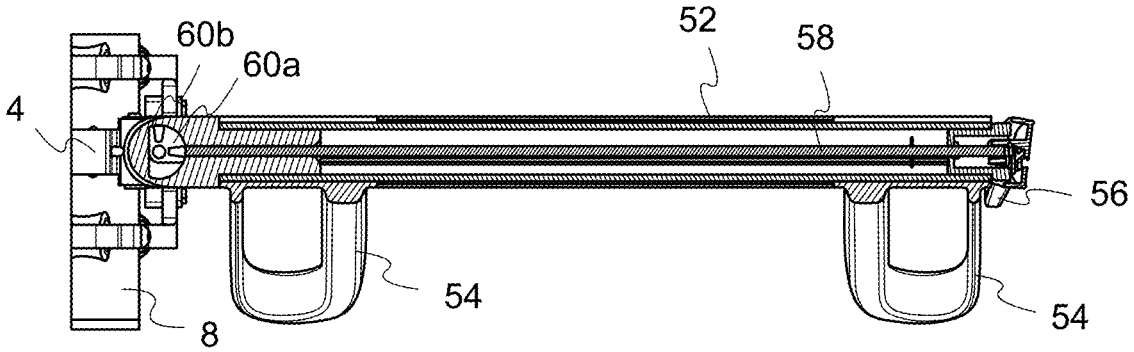
FIGS. 10 and 11 show a top and side view of the handle unlocking mechanism which enables the handle to be folded away.
Figure 11:
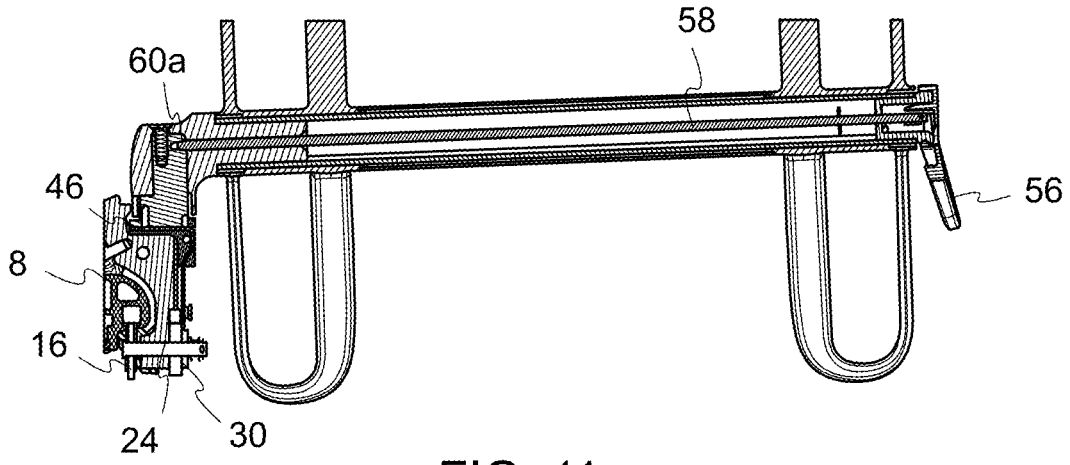

FIG. 9 shows the handle 2, which comprises a central gripping portion 52 and two lateral gripping portions 54. Each lateral gripping portion 54 includes an upper portion 54*a* which extends vertically upwards from the central gripping portion 52, and a lower portion 54*b* which extends vertically downwards from the central gripping portion 52. Each of the upper and lower portions comprises a loop which makes it easier for the user to hold the handle 2.

The handle 2 is normally locked in the position shown in FIG. 1. In order to fold the handle 2 away, e.g. to save space in the stairway, the handle 2 comprises the folding mechanism 10. The folding mechanism 10 comprises a single rotating joint which permits rotating of the handle about a vertical axis. The rotating joint comprises a fixed portion fixed to the saddle and a rotating portion fixed to the handle and rotatable relative to the fixed portion about the vertical axis. The folding mechanism 10 further comprises an actuation lever 56 and a spring lock comprising a rod 58 extending through the central gripping portion 52 and coupled to the actuation lever 56. In the locked position, a proximal end of the rod 58 extends into a first opening 60*a* in the fixed portion of the rotating joint which prevents any change in orientation of the handle 2 relative to the saddle 4. When the actuation lever 56 is pressed in a direction toward the guide rail 8, the rod 58 is pulled out of the first opening 60*a*, thus enabling the handle 2 to be rotated and folded away. When the handle 2 reaches the folded position, which is a position in which a plane of the handle 2 is parallel to the plane of the wall of the stairway, the rod 58 is biased into a second opening 60*b* in the rotating joint by a spring which thus locks the handle 2 in the folded position.

Figure 12:
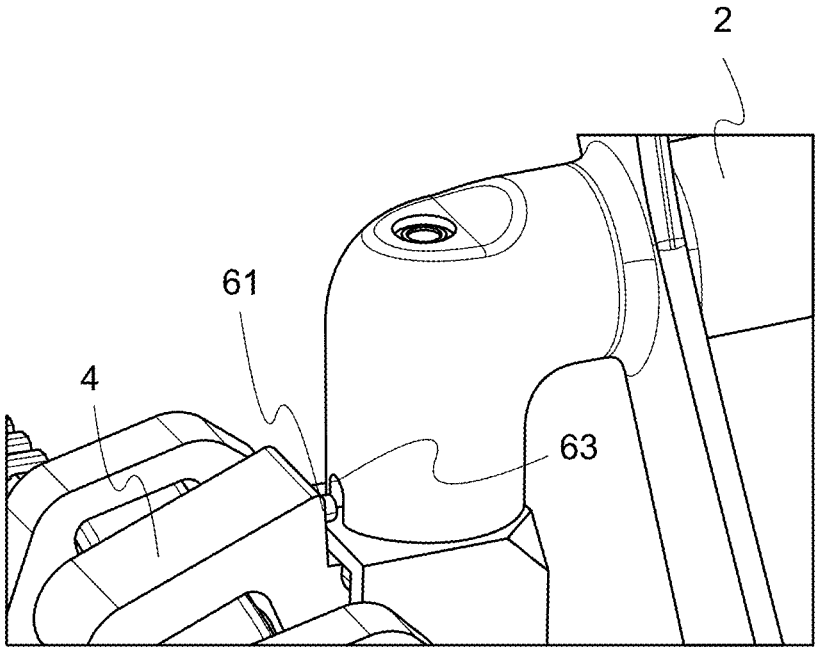
FIGS. 12 and 13 show how the handle can be prevented from disengaging the pawl when the handle is in the folded position.
Figure 13:
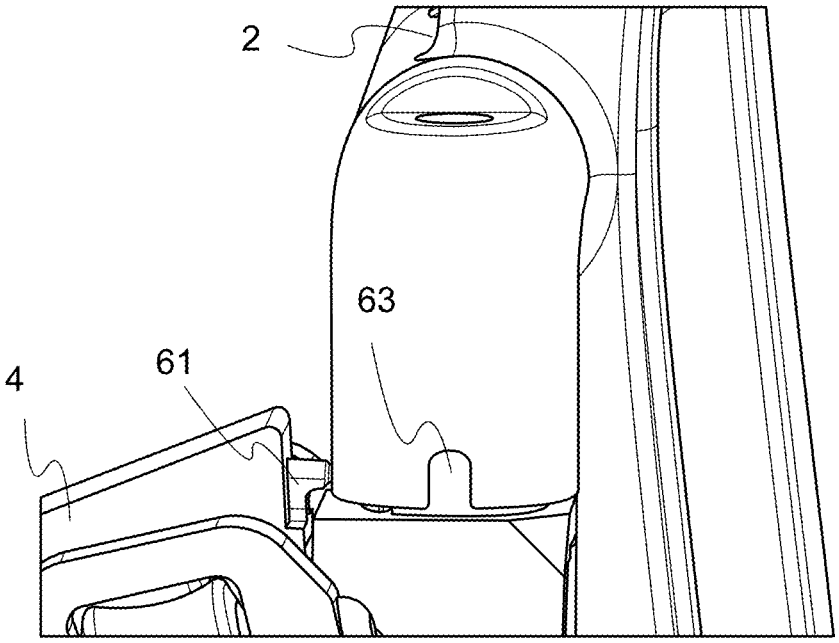

FIGS. 12 and 13 show how the stair assistance device 1 can prevent the pawl 32 from being disengaged when the handle 2 is in the folded position. The saddle 4 comprises a protrusion 61 located on a surface of the saddle 4 adjacent to the handle 2, and the handle 2 comprises an aperture 63 located on a surface of the handle 2 which is adjacent to the saddle 4 in the normal position. When the handle 2 is in the normal position, as shown in FIG. 12, the protrusion 61 and the aperture 63 are aligned. When the handle 2 is lifted in the predetermined movement, the protrusion 61 fits into the aperture 63 in the handle 2 and hence does not obstruct lifting of the handle 2. The ratchet pull spring 44 can therefore pull the pawl 32 out of engagement. When the handle 2 is in the folded position as shown in FIG. 13, the protrusion 61 and the aperture 63 are out of alignment. Thus, when the user tries to lift the handle 2, the protrusion 61 abuts the surface of the handle 2 and obstructs its movement, thereby preventing the handle 2 from lifting and thus preventing the ratchet pull spring 44 from disengaging the pawl 32. The pawl 32 is therefore locked in place when the handle 2 is in the folded position.

Figure 14:
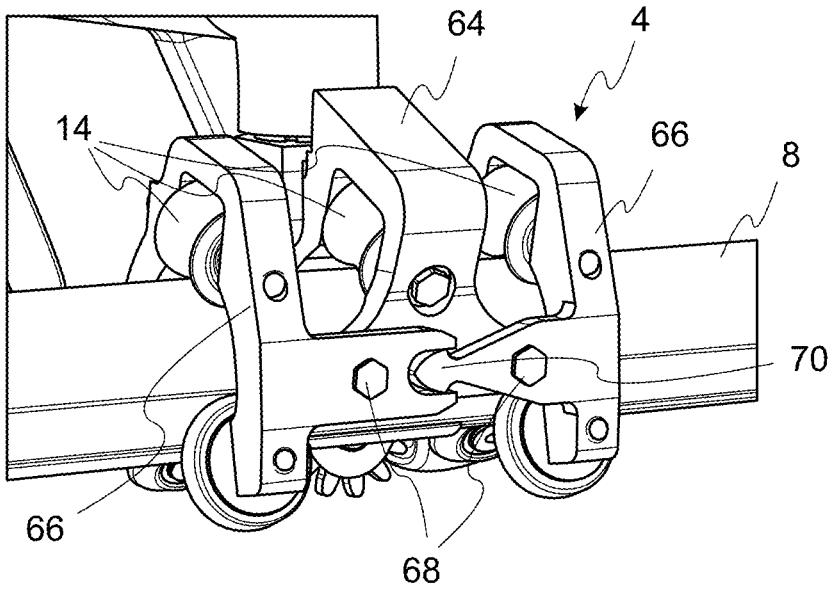
FIGS. 14, 15 and 16 show the back of the saddle with a frame assembly that enables the saddle to move around bends.
Figure 15:
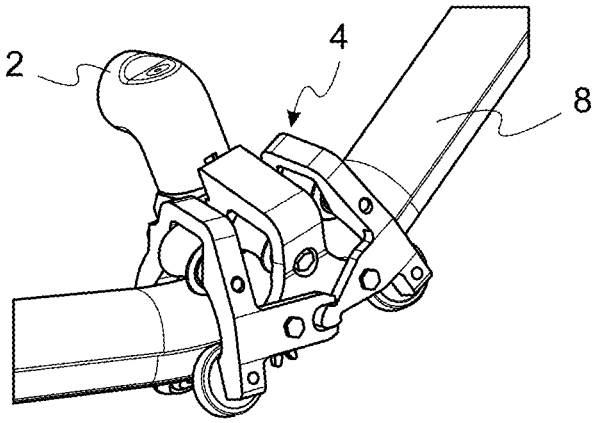
Figure 16:
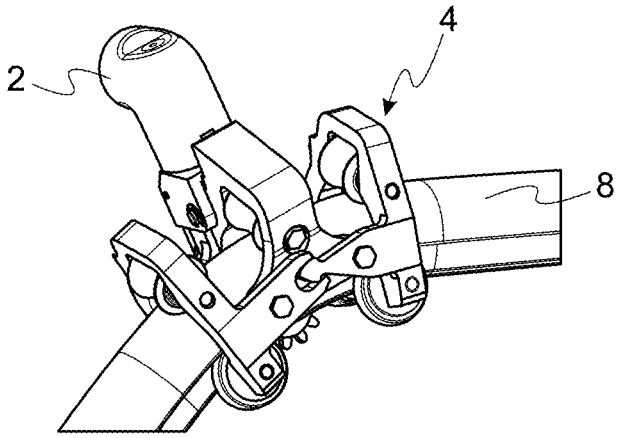

FIGS. 14, 15 and 16 show the back side of the saddle 4, i.e. the side opposite to the handle 2. The saddle 4 comprises a frame assembly 62 which provides a support structure to which the various components of the saddle 4 are mounted. The frame assembly 62 comprises a main frame 64 and two side frames 66 located adjacent to and on either side of the main frame 64. Each side frame 66 is connected to the main frame 64 by a fastener 68, and can pivot about the fastener 68. Additionally the side frames 66 are connected to each other via a ball-and-socket type joint 70. The side frames 66 therefore have a degree of articulation/relative movement as compared to rigidly-formed frame assemblies. This enables the frame assembly 62 to accommodate bends in the guide rail 8, while retaining a tight fit to the guide rail 8. Each frame comprises at least one roller or wheel 14 to ensure smooth sliding of the saddle 4 along the rail 8.

Figure 17:
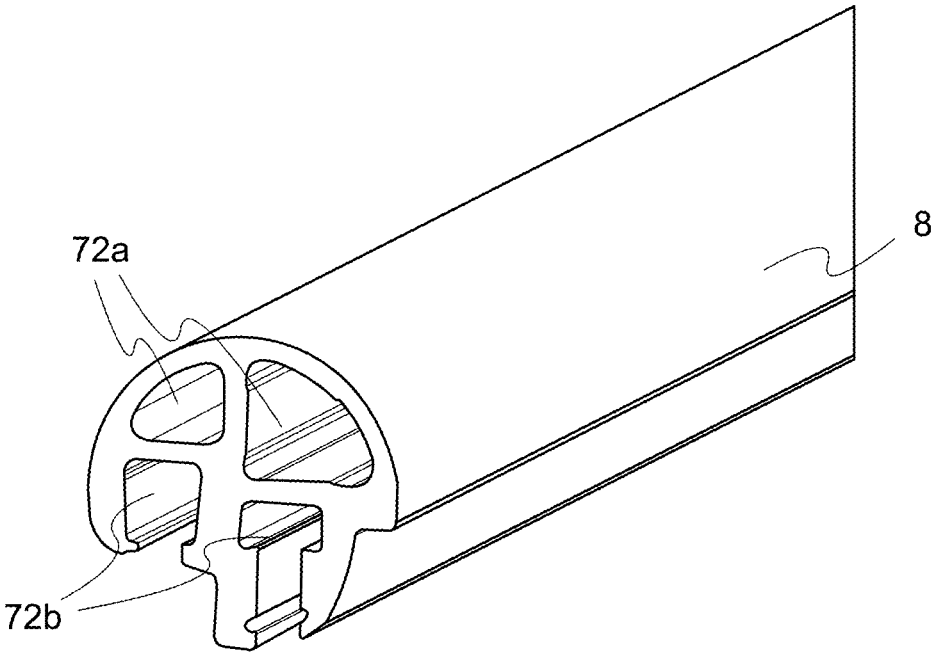
FIG. 17 shows the internal structure of the guide rail.

FIG. 17 shows the internal structure of a guide rail 8 which has been adapted for use with the stair assistance device 1. The rail 8 includes four channels 72 extending therethrough: two closed channels 72*a* and two open channels 72*b*. The closed channels 72*a* are sealed except for an opening at each end of the guide rail 8, which permits insertion of cables, rail-connecting components etc. The open channels 72*b* (also termed 'slots') are exposed on one side along the length of the rail 8. This can enable the inclusion of components which are required to be accessed externally, such as wall-brackets 76 for mounting the guide rail 8 to a wall, grip strips for providing grip to users of the guide rail 8, the engagement rack 6 of the stair assistance device 1, etc.

Figure 18:
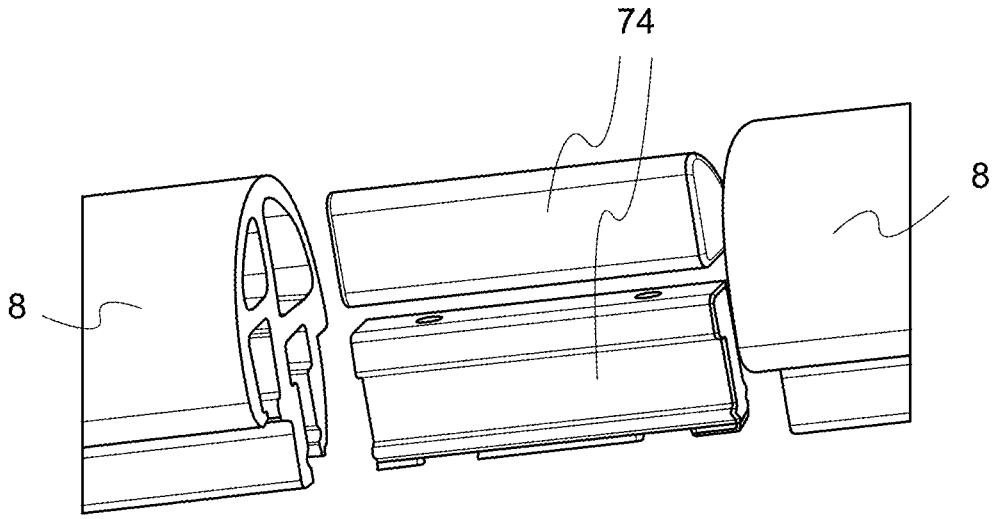
FIG. 18 shows rail-connecting components for connecting two guide rails.

As shown in FIG. 18, two guide rail sections can be joined together using one or more rail-connecting components 74, which in this example are bolts 74. The bolts are sized and shaped to fit into a channel 72 of each rail section with a friction fit. In this way, longer guide rails 8 can be formed, and different shaped sections can be connected to form rails suited to the particular stairway in which they are installed. Two bolts 74 are pictured here, but one or more bolts 74 may be used to connect each pair of guide rail sections.

Figure 19:
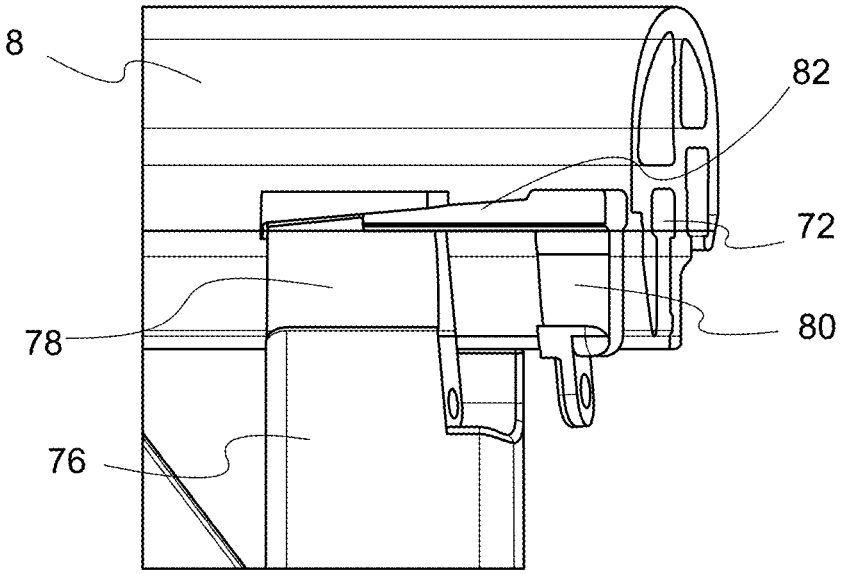
FIGS. 19 and 20 show how a bracket is connected to a guide rail.
Figure 20:
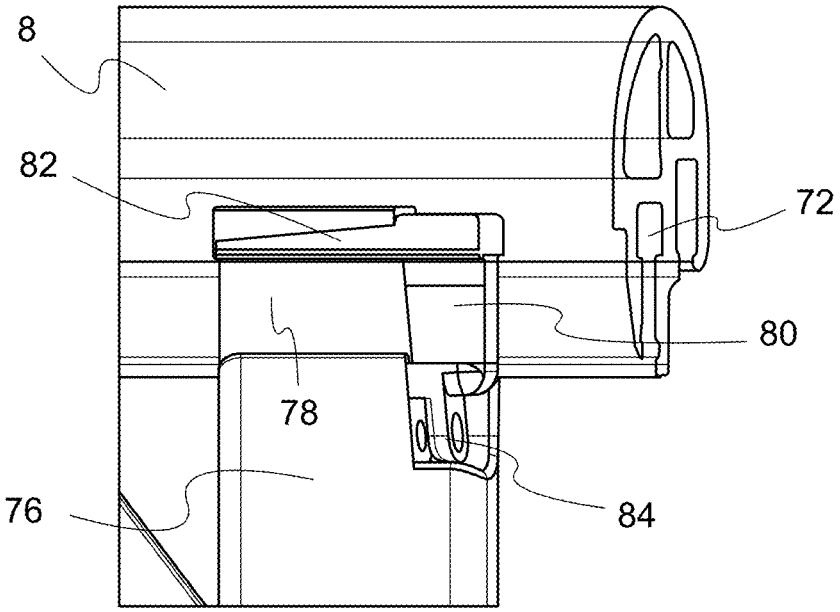

FIGS. 19 and 20 illustrate how a bracket 76 for connecting the guide rail 8 to a wall and/or the floor is connected to the rail 8. The bracket 76 includes an insertion portion 78 which fits into a channel 72 of the guide rail 8. The insertion portion 78 is sized and shaped so as to substantially match the contour of the channel 72 to enable insertion thereof while ensuring a close fit. The bracket 76 is then tightened to the guide rail 8 using a bracket-tension component 80. The bracket-tension component 80 includes a body portion which is sized and shaped to substantially match the contour of the channel 72, and a tapered portion 82 which extends from the body portion in a direction along the channel 72. The bracket-tension component 80 is inserted into the channel 72 and the tapered portion 82 enters a narrowing opening in the bracket insertion portion 78. The tapered portion 82 is sized slightly larger than the narrowing opening such that as the tapered portion 82 enters the narrowing opening, the bracket insertion portion 78 expands outwardly against the channel 72 of the guide rail 8. This secures the bracket 76 under tension, creating a secure fit of the bracket 76 to the guide rail 8. The bracket-tension component 80 is then fastened to the bracket 76 using a bolt 84. As the bolt 84 is tightened, the tapered portion 82 will be wedged further inside the narrowing opening, thus increasing the tension of the fit.

Figure 21:
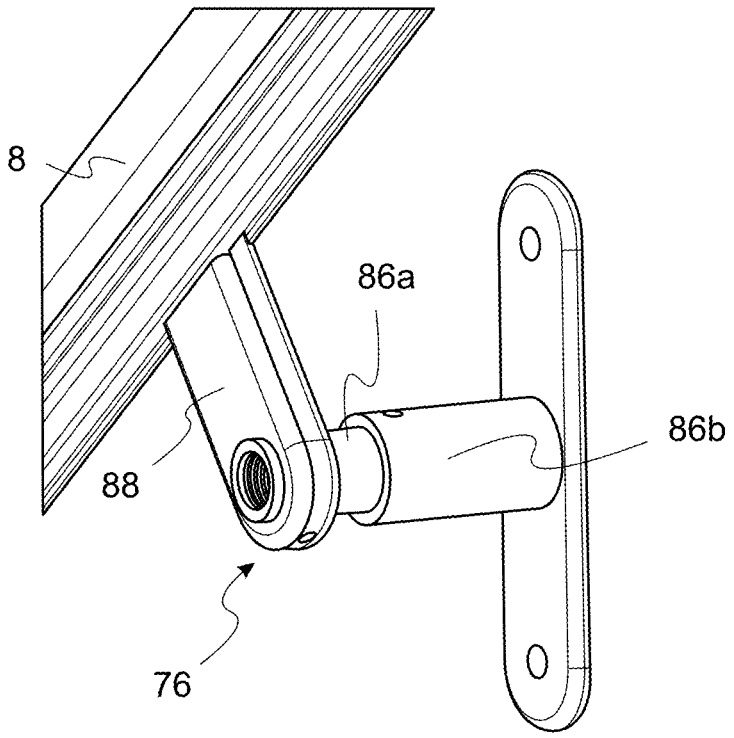
FIG. 21 shows a guide rail mounted to a wall by a bracket.

FIG. 21 shows the bracket component being used to mount the guide rail 8 to a wall. As shown in FIG. 21, the bracket 76 is adjustable to provide flexibility in installation, depending on the relative position and orientation of the rail 8 and the wall/ground. The bracket 76 includes a telescopic portion 86 for adjusting the depth of the bracket 76 when the distance between the rail 8 and the wall varies. The telescopic portion 86 includes a first portion slidably engaged within a second portion. The length of the telescopic portion 86 is determined by using a fastener (e.g. a set screw) to set the position of the first portion relative to the second portion. The bracket 76 also includes a rotatable portion 88 for adjusting the angle of the bracket 76 relative to the rail 8. The rotatable portion 88 is rotatably coupled to the telescopic portion 86 and can rotate about an axis defined by the telescopic portion 86. The angle of the rotatable portion 88 is set using a set screw.

Figure 22:
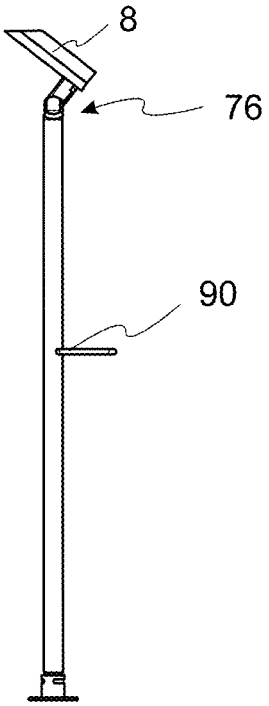
FIG. 22 shows a guide rail mounted to the ground by a bracket and a pole.

As shown in FIG. 22, the bracket 76 can also be used to mount to guide rail 8 to the ground if there is no suitable wall nearby. The rotatable portion 88 is coupled directly to a pole 90 which extends from the ground.

The invention claimed is:

1. A stair assistance device for assisting a person to climb up and down stairs, the device comprising:

a handle;

a saddle for engagement with a guide rail mounted alongside the stairs, the saddle being connected to the handle; and an engagement rack for attachment to and extending along the length of the guide rail, the saddle being engaged with the engagement rack;

wherein the saddle is arranged for sliding motion along the guide rail and for selectively preventing motion of the handle and saddle along the guide rail, the saddle comprising:

a releasable ratchet mechanism comprising a pawl engageable with a ratchet which, when engaged, prevents movement of the handle in a downstairs direction and allows movement of the handle in an upstairs direction; and wherein the handle is coupled to the pawl such that a predetermined movement of the handle relative to the guide rail will disengage the pawl;

wherein the ratchet is a ratchet wheel comprising angled teeth spaced around the circumference of the ratchet wheel, and wherein the pawl comprises a finger arranged to engage with the angled teeth; and wherein the ratchet wheel and a sprocket are mounted to a common axle such that rotation of the sprocket and rotation of the ratchet wheel is synchronised.

2. The stair assistance device as claimed in claim 1, wherein the engagement rack comprises a strip of generally rigid material with teeth spaced along the strip, and wherein the saddle comprises a sprocket, wherein teeth of the sprocket are arranged to interlock with the teeth of the engagement rack.

3. The stair assistance device as claimed in claim 1, wherein the saddle comprises a biasing element arranged to bias the pawl into engagement with the ratchet.

4. The stair assistance device as claimed in claim 1, comprising a folding mechanism that enables the handle to be folded away.

5. The stair assistance device as claimed in claim 4, wherein the folding mechanism comprises a single rotating joint that couples the handle to the saddle, with the rotating joint being mounted to the saddle to provide a rotation of the handle, the rotation including a component of rotation about a vertical axis.

6. The stair assistance device as claimed in claim 5, wherein the folding mechanism comprises a spring lock which prevents rotation of the handle until it is disengaged, wherein the spring lock automatically engages when the handle is in a position for normal use and optionally engages when the handle is in the folded position.

7. The stair assistance device as claimed in claim 6, wherein the spring lock comprises a releasable rod extending through the handle and engaging with the rotating joint, wherein a first end of the rod is coupled to an actuation lever for disengaging the rod.

8. The stair assistance device as claimed in claim 1, wherein the saddle can be installed on both a left-hand side and a right-hand side of the stairs.

9. The stair assistance device as claimed in claim 1, wherein the stair assistance device comprises the guide rail, wherein the guide rail optionally includes at least one internal channel extending therethrough.

10. The stair assistance device as claimed in claim 9, comprising at least two guide rails, wherein the guide rails are connected by a rail-connecting component inserted into the channel of each guide rail.

11. The stair assistance device as claimed in claim 1, wherein the handle comprises a central gripping portion and one or more lateral gripping portions extending vertically outwards from the central gripping portion.

12. A stair assistance device for assisting a person to climb up and down stairs, the device comprising:

a handle;

a saddle for engagement with a guide rail mounted alongside the stairs, the saddle being connected to the handle;

an engagement rack for attachment to and extending along the length of the guide rail, the saddle being engaged with the engagement rack;

wherein the saddle is arranged for sliding motion along the guide rail and for selectively preventing motion of the handle and saddle along the guide rail, the saddle comprising:

a releasable ratchet mechanism comprising a pawl engageable with a ratchet which, when engaged, prevents movement of the handle in a downstairs direction and allows movement of the handle in an upstairs direction; and wherein the handle is coupled to the pawl such that a predetermined movement of the handle relative to the guide rail will disengage the pawl; and a friction clutch mechanism coupled to the ratchet mechanism, the friction clutch mechanism including a clutch lever configured to disengage the pawl when the handle is moved in the upstairs direction and to engage the pawl when the handle is moved in the downstairs direction, wherein the predetermined movement of the handle prevents the clutch lever from engaging the pawl.

13. The stair assistance device as claimed in claim 12, wherein the ratchet is a ratchet wheel comprising angled teeth spaced around the circumference of the ratchet wheel, and the friction clutch mechanism comprises a clutch disc arranged to be frictionally driven by the ratchet wheel.

14. The stair assistance device as claimed in claim 13, comprising a friction washer in contact with and arranged between the ratchet wheel and the clutch disc.

15. The stair assistance device as claimed in claim 13, wherein the clutch disc is arranged to actuate the clutch lever to engage or disengage the pawl based on rotation of the ratchet wheel.

16. The stair assistance device as claimed in claim 13, wherein a first end of the clutch lever is fixed to or integrally formed with the pawl and a second end of the clutch lever is coupled to the clutch disc, wherein the second end of the clutch lever is seated in a notch in the circumference of the clutch disc.

17. The stair assistance device as claimed in claim 12, wherein the angle between the clutch lever and the pawl is fixed.

18. A stair assistance device for assisting a person to climb up and down stairs, the device comprising:

a handle;

a saddle for engagement with a guide rail mounted alongside the stairs, the saddle being connected to the handle; and an engagement rack for attachment to and extending along the length of the guide rail, the saddle being engaged with the engagement rack;

wherein the saddle is arranged for sliding motion along the guide rail and for selectively preventing motion of the handle and saddle along the guide rail, the saddle comprising:

a releasable ratchet mechanism comprising a pawl engageable with a ratchet which, when engaged, prevents movement of the handle in a downstairs direction and allows movement of the handle in an upstairs direction; and wherein the handle is coupled to the pawl such that a predetermined movement of the handle relative to the guide rail will disengage the pawl;

wherein the saddle comprises a ratchet pull element arranged such that, in a first position of the ratchet pull element, the pawl can move freely between the engaged and disengaged position and, in a second position of the pull element, the ratchet pull element retains the pawl in the disengaged position.

19. The stair assistance device as claimed in claim 18, wherein the ratchet pull element has an elongated shape comprising a flange at one end, wherein, in the second position, the flange obstructs movement of the pawl.

20. The stair assistance device as claimed in claim 18, wherein the predetermined movement is a lifting of the handle to rotate the handle about the long axis of the guide rail to move the ratchet pull element from the first position to the second position and thereby disengage the pawl.

21. A stair assistance device for assisting a person to climb up and down stairs, the device comprising:

a handle;

a saddle for engagement with a guide rail mounted alongside the stairs, the saddle being connected to the handle; and an engagement rack for attachment to and extending along the length of the guide rail, the saddle being engaged with the engagement rack;

wherein the saddle is arranged for sliding motion along the guide rail and for selectively preventing motion of the handle and saddle along the guide rail, the saddle comprising:

a releasable ratchet mechanism comprising a pawl engageable with a ratchet which, when engaged, prevents movement of the handle in a downstairs direction and allows movement of the handle in an upstairs direction; and wherein the handle is coupled to the pawl such that a predetermined movement of the handle relative to the guide rail will disengage the pawl;

wherein the saddle comprises a frame assembly including one or more frames arranged for slidable movement along the guide rail; and wherein the frame assembly comprises a main frame arranged to house the ratchet mechanism and a friction clutch mechanism, and at least one side frame adjacent and coupled to the main frame.

22. The stair assistance device as claimed in claim 21, wherein the saddle is configured to permit articulation of the main frame and the at least one side frame.

* * * * *